United States Patent [19]

Ahern et al.

[11] Patent Number: 4,714,939

[45] Date of Patent: Dec. 22, 1987

[54] ELECTROGRAPHIC REPRODUCTION APPARATUS

[75] Inventors: Douglas K. Ahern, Rochester; William Y. Fowlkes, Fairport; Donald S. Rimai, Webster, all of N.Y.

[73] Assignee: Eastman Kodak Company, Rochester, N.Y.

[21] Appl. No.: 894,174

[22] Filed: Aug. 7, 1986

Related U.S. Application Data

[63] Continuation-in-part of Ser. No. 794,879, Nov. 4, 1985.

[51] Int. Cl.[4] ..... G03G 15/00

[52] U.S. Cl. ..... 355/3 TR; 355/3 R; 355/14 TR; 355/24

[58] Field of Search ..... 355/3 R, 14 R, 3 TR, 355/14 TR, 3 BE, 16, 23, 24

[56] References Cited

U.S. PATENT DOCUMENTS

| | | | |
|---|---|---|---|
| 3,580,670 | 5/1971 | Bhagat | 355/3 R |
| 3,671,118 | 6/1972 | Fantuzzo et al. | 355/3 R |
| 3,687,541 | 8/1972 | Aser et al. | 355/14 R |
| 3,697,171 | 10/1972 | Sullivan | 355/17 |
| 3,775,102 | 11/1973 | Punnett | 355/3 R X |
| 3,847,478 | 11/1974 | Young | 355/3 R |
| 4,111,547 | 9/1978 | Stemmle | 355/24 |
| 4,362,382 | 12/1982 | Simpson | 355/16 X |
| 4,371,251 | 2/1983 | Morse | 355/16 X |
| 4,427,285 | 1/1984 | Stang | 355/24 X |

*Primary Examiner*—A. C. Prescott

*Attorney, Agent, or Firm*—Lawrence P. Kessler

[57] ABSTRACT

An electrographic reproduction apparatus, of the single-pass type, capable of producing simplex or duplex copies on a receiver sheet traveling in a continuous direction along a path. The reproduction apparatus comprises a first dielectric member movable along a first path, a portion of such first path being tangent to and on one side of the sheet travel path. Transferable images, corresponding to information to be reproduced, are sequentially formed on such first member. A second member is movable along a second path. One portion of such second path is tangent to the sheet travel path on the opposite side from the first path; and another portion of the second path, spaced from such one portion, is located to position the second member in image transfer relation to the first dielectric member. An electrostatic field, reversible in its effective direction, is utilized to transfer a transferable image from the first dielectric member to the second member at the portion of the second path where the first and second members are in image transfer relation, and transfer such image from the second member to one side of a receiver sheet traveling along its travel path at the location where the position of the first path is tangent to the sheet travel path; and for producing a duplex copy, a second image is transferred from the first dielectric member to the opposite side of such receiver sheet at the location where the portion of the first path is tangent to the sheet travel path.

12 Claims, 7 Drawing Figures

ELECTROGRAPHIC REPRODUCTION APPARATUS

RELATED APPLICATION

This is a continuation-in-part of U.S. patent application Ser. No. 794,879 filed Nov. 4, 1985.

BACKGROUND OF THE INVENTION

This invention relates generally to electrographic reproduction apparatus, and more particularly to electrographic reproduction apparatus capable of simplex or single pass duplex copying.

Electrographic reproduction apparatus typically produce copies of original information on receiver members, such as cut sheets of plain bond paper. Such information copies may be respectively formed on one side of the paper sheets (referred to as simplex copies), or on both sides of such sheets (referred to as duplex copies). In certain circumstances, such as the reproduction of multi-page documents, duplex copies are desirable. This is principally due to the fact that with duplex copies there is a reduction in the amount of paper used, and duplex copies of a multi-page document are easier to read.

Commercial reproduction apparatus capable of producing duplex copies are generally classified as "two-pass" or "single pass" apparatus. In "two-pass" reproduction apparatus, information is sequentially produced electrographically on the first sides of sheets which are thereafter collected in an intermediate tray. Such sheets are then sequentially transported back through the apparatus to have information electrographically produced on the second sides of such sheets. As a result a relatively long travel path is required for transporting sheets through the reproduction apparatus twice to produce duplex copies. Therefore, the potential for jams or other sheet handling complications is increased. Moreover, the first completed duplex copy is not available for inspection until after all first side copies are produced. Thus considerable time elapses until the first completed duplex copy is produced, and any errors in such duplex copy are not determined until after all first side copies have already been made.

In single-pass reproduction apparatus selected information is electrographically produced on opposite sides of a sheet during a single pass through such apparatus. While single-pass apparatus are successful in overcoming the noted disadvantages of two-pass electrographic reproduction apparatus, they tend to introduce, in and of themselves, other disadvantages or complications. For example, U.S. Pat. No. 3,775,102 (issued Nov. 27, 1973, in the name of Punnett) shows two separate substantially complete electrographic process assemblies for reproducing information respectively on each side of a sheet. Such duplicative assemblies require precise optical alignment, substantially increase apparatus cost, and add significant complexities which reduce reliability of the apparatus.

To eliminate duplicative process assemblies, the single pass reproduction apparatus may employ an electrically biased doner/transfer roller for simultaneously transferring imagees corresponding to information to be reproduced respectively to each side of a sheet, such as shown for example in U.S. Pat. No. 3,847,478 (issued Nov. 12, 1974, in the name of Young). However, the doner/transfer roller is of complex construction and requires accurate bias control to accomplish the simultaneous image transfers. Simplification of the transfer apparatus may be accomplished by utilizing spaced conventional transfer apparatus associated with a single electrographic process assembly, such as shown for example in U.S. Pat. No. 4,194,829 (issued Mar. 25, 1980, in the name of Cavagnaro). Such apparatus requires a complex, precisely controllable sheet handling mechanism which turns the sheet over between transfers to copy information on both sides thereof.

SUMMARY OF THE INVENTION

This invention is directed to an electrographic reproduction apparatus, of the single-pass type, capable of producing simplex or duplex copies on a receiver sheet traveling in a continuous direction along a path. The reproduction apparatus comprises a first dielectric member movable along a first path, a portion of such first path being tangent to and on one side of the sheet travel path. Transferable images, corresponding to information to be reproduced, are sequentially formed on such first member. A second member is movable along a second path. One portion of such second path is tangent to the sheet travel path on the opposite side from the first path; and another portion of the second path, spaced from such one portion, is located to position the second member in image transfer relation to the first dielectric member. An electrostatic field, reversible in its effective direction, is utilized to transfer a transferable image from the first dielectric member to the second member at the portion of the second path where the first and second members are in image transfer relation. The image from the second member is transferred to one side of a receiver sheet traveling along its travel path at the location where the position of the first path is tangent to the sheet travel path; and a second image is transferred from the first dielectric to the opposite side of such receiver sheet at the location where the portion of the first path is tangent to the sheet travel path. The image transfers, in order to produce duplex copy, are operatively controlled to be effected in the following order: (1) transfer of one image from the first dielectric member to the second member, (2) transfer of such one image from the second member to one side of a receiver sheet, and (3) transfer of a second image from the first dielectric member to the opposite side of such receiver sheet.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
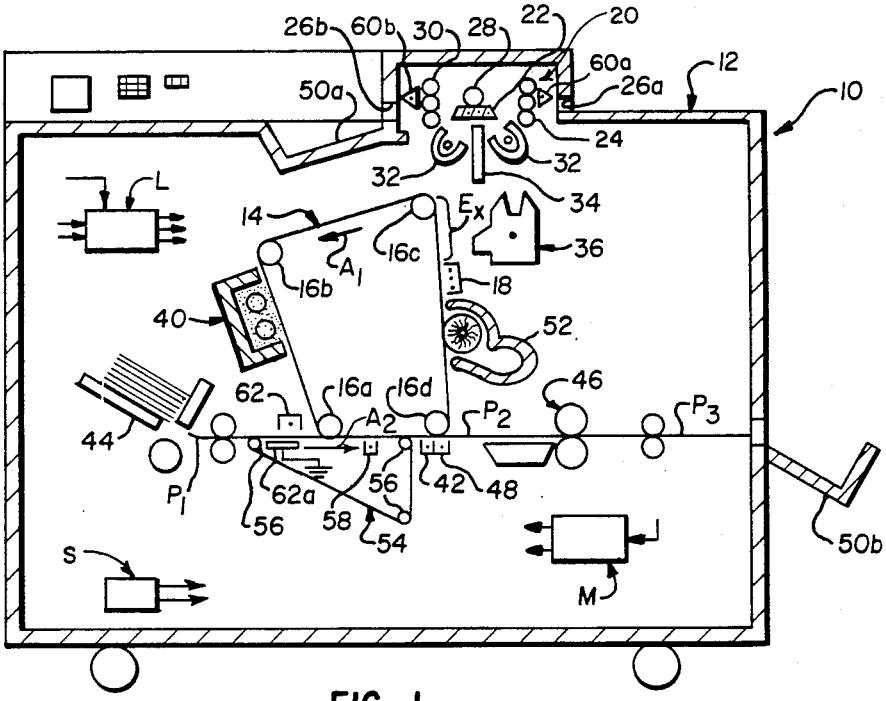
FIG. 1 is a schematic, front elevational view, partly in cross-section, of an electrographic reproduction apparatus capable of simplex or single pass duplex copying, according to this invention.
Figure 4:
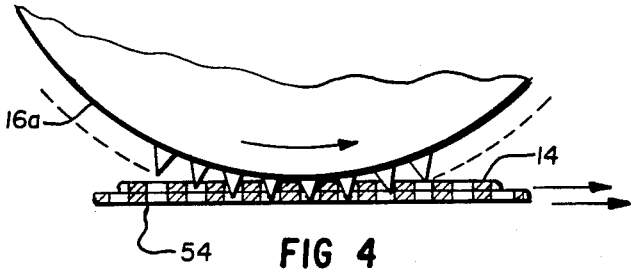
FIG. 4 is a front elevational view, on an enlarged scale, of the sprocket for drivig the dielectric webs of the reproduction apparatus of FIG. 1.

Referring now to the accompanying drawings, an electrographic reproduction apparatus 10 capable of single pass duplex copying, according to this invention, is schematically shown in FIG. 1. The reproduction apparatus 10 includes a housing 12 in which a first dielectric member is supported. Although the first member could be a drum, it is preferrably an endless dielectric web 14 is supported by rollers 16a–16d. One of the rollers (e.g. roler 16a) is driven by motor M and includes, for example, sprocket teeth (see FIG. 4) for engaging perforations adjacent to a marginal edge of the web 14 to move the web about a closed loop path in the direction of arrow $A_1$. The web 14 is a composite structure having a photoconductive surface layer with a plurality of image receiving areas and a grounded conductive support layer such as shown for example in U.S. Pat. No. 3,615,414 (issued Oct. 26, 1971 in the name of Light). Typical electrographic process stations are located about the periphery of the web 14 in operative relation with the image receiving areas.

Control of the reproduction apparatus 10 and the electrographic process stations are accomplished by a logic and control unit L including a microprocessor for example. The microprocessor receives operator input signals and timing signals, for example from sensors (not shown) detecting movement of the web 14 about its closed loop path. Based on such signals and a program for the microprocessor, the unit L produces signals to control the timing operation of the various electrographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

The electrographic process stations function in the following manner to produce simplex copies. A corona charger 18, coupled to a D.C. or biased A.C. electrical potential source (not shown), applies a uniform electrostatic charge to the web 14 as it moves past the charger. The uniform charge, in an image receiving area of the web, is altered as the web passes through zone $E_x$ to form an image-wise change pattern in such area corresponding to information to be copied. For example, the image-wise charge pattern is formed by exposure of the image-receiving area of the web to a reflected light image of such information. Of course, formation of an image-wise charge pattern on the web may be alternately accomplished by other suitable methods such as by exposure to electronically (e.g. LED array or laser scanner) or electrostatically produced images.

In the illustrated apparatus 10, exposure is accomplished by utilizing a feeder 20 to transport a document of original information across a transparent platen 22. The feeder 20 includes a roller cluster 24 located adjacent to an opening 26a in the housing 12. When a document is inserted through the opening 26a into the roller cluster 24, with its information-bearing surface to be copied face down, the nip roller pair is driven to transport the document across the platen 22 in the proper direction for scan exposure (i.e., from right to left in FIG. 1) and at a speed substantially equal to the peripheral speed of the moving web 14. A rotating scuff roller 28 maintains the document in intimate contact with platen and urges the document toward a roller cluster 30 which directs the document through opening 26b to a hopper 50a for operator retrieval. Of course other feeders for transporting a document across the platen are suitable for use with this invention.

As the document traverses the platen 22, lamps 32 are turned on and illuminate the document. A reflected light image of the document is collected by a lens 34 and projected by a mirror assembly 36 onto an image receiving area of the web. The lens 34 is for example a fiber optic array extending for the full width of the platen 22 measured in the direction tranverse to document movement. The mirror assembly 36, similarly extending for the full width of the platen 22, includes first and second mirror surfaces 38a, 38b. When the assembly 36 is located in the position of FIG. 3, sequential line segments of the reflected light image are projected from lens 34 off mirror surfaces 38a and 38b onto the web 14. Such reflected light image line segments alter the uniform charge in an image-receiving area on the web to form a charge pattern corresponding image-wise to the document to be reproduced. As the web moves about its path, the area bearing the image-wise charge patern is brought into operative relation with a developer station 40. The developer station 40 is for example a magnetic brush such as described in U.S. Pat. No. 3,457,900 (issued July 29, 1969 in the name of Drexler). The magnetic brush brings marking paricles into contact with the moving web. Such particles adhere to he charge pattern to develop the pattern and form a transferable image.

The image-receiving area of he web 14 containing the transferable image travels about the closed loop path to a transfer station having a corona charger 42 couple to a D.C. or biased A.C. electrical potential source for example. A receiver member,such as a sheet of plain paper, is fed from a supply hopper 44 and transported along a path $P_1$ to the corona charger 42 in timed relation with the moving web 14 so that the receiver member is in register with the transferable image. The charger 42 establishes an electrostatic field to effect transfer of the transferable image from the web 14 to the receiver member. After transfer, the receiver member is stripped from the web and transported along path $P_2$ to a fuser assembly 46 where the transferred image is fixed to such member by heat and/or pressure for example. Stripping of the receiver member may be facilitated by a corona charger 48, coupled to an A.C. potential source, which neutralizes electrostatic forces holding the receiver member to the web. After the transferred image is fixed to the receiver member, the member is directed along path $P_3$ to an output hopper 50b for operator retrieval. As is apparent, receiver member paths $P_1$, $P_2$ and $P_3$ describe a substantially straight line. Such straight line path enhances reliability of receiver member handling. Substantially simultaneously with transport of the receiver member along path $P_3$, the utilized image-receiving area of the web 14 moves through a cleaning station 52 where residual (non-transferred) marking particles are removed by a rotating fiber brush for example, and returned to the area of the charger 18 to be conditioned for reuse.

In order for the apparatus 10 to be capable of producing duplex copies, the apparatus includes a second endless dielectric web 54. The web 54, which may be similar to web 14, does not include photoconductive or grounding layers. Rollers 56 support the web 54 for movement about a closed loop path, a portion of such path being in juxtaposition with the web 14, immediately upstream of transfer charger 42, and in juxtaposition with the receiver member travel path on the opposite side thereof from the web 14. The web 54 is driven about its closed loop path in synchronism with the web 14 in the direction of arrow $A_2$ by the sprocket teeth of roller 16*a* which engage perforations adjacent to a marginal edge of the web 54 (see FIG. 4).

The operation of apparatus 10 for producing duplex copies is as follows: The mirror assembly 36 is rotated about its longitudinal axis B to the position of FIG. 2. In such position a third mirror surface 38*c* lies in the optical path between lens 34 and web 14, and describes a conjugate distance from the object plane (platen 22) to the image plane (web 14) equal to the conjugate distance from the object plane to the image plane described by mirror surfaces 38*a* and 38*b*. However, for the purpose to be explained hereinbelow, with the mirror assembly 36 in the position of FIG. 2, the reflected light image of a document transported across platen 22 is only reversed once, as compared to twice when the assembly is in the position of FIG. 3.

Drive for the web 14 about its closed loop path into operative relation with the electrographic process stations is initiated by the unit L, and a first document is transported across the platen 22 by the feeder 20. Due to the fact that there is only one mirror surface (38*c*) in the optical path, the direction of transport for the first document is from left to right in FIG. 1 in order for the document to be moving in the proper direction for scan exposure. The information of such document exposes an area of the uniformly charged web 14 and a corresponding transferable image is formed thereon in the same manner as described above. As the web 14 is driven about its closed loop path by the sprocket of roller 16*a*, the web 54 is also driven by such sprocket about its closed loop path. Since the same sprocket is effecting the drive of both webs, the peripheral speed of web 54 matches the peripheral speed of 14 so that smearing of the image during transfer is prevented and registration between the webs is maintained. Then instead of the image formed on web 14 being transferred directly to a receiver member, such image is transferred to the web 54 moving in synchronism with the web 14. Transfer of the image to web 54 is effected by a corona charger 58 electrically coupled to a D.C. or biased A.C. potential source S. The charger 58 produces an electrostatic field sufficient to attract the marking particles of such image from web 14 to web 54.

Figure 3:
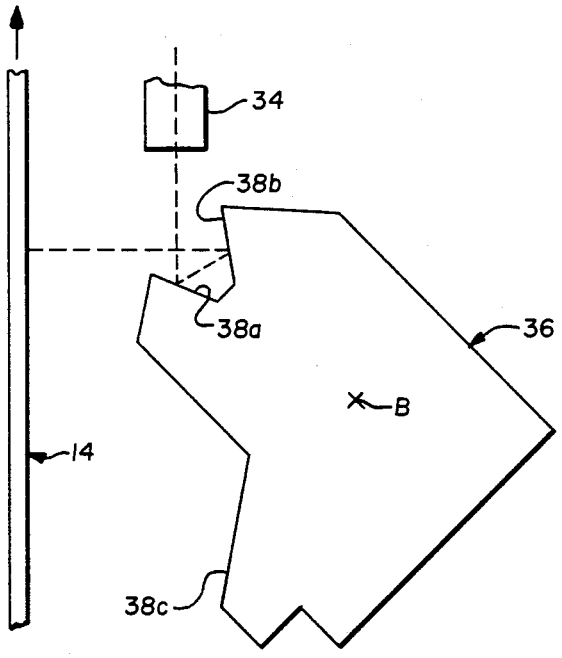
FIG. 3 is a front elevational view, partly similar to FIG. 2, of a portion of an exposure mechanism with the mirror assembly in an alternate position.

As the first transferable image is being formed and transported to its transfer location, the mirror assembly 36 is rotated about its longitudinal axis B to its position of FIG. 3. Information of a second document transported by feeder 20 across the platen 22 in the opposite direction to that of the first document for proper scan exposure (i.e., from right to left in FIG. 1) then exposes a subsequent image-receiving area of the uniformly charged web 14 and a corresponding transferable image is similarly formed thereon. Of course, the first document may be of the duplex type (i.e., it contains information on both sides). Accordingly information on one side of such duplex document is used for the first exposure, and the document is then inverted and returned to the platen 22 by the feeder 20 whereby information on the opposite side is used for the second exposure. Such inversion and return of the document is effected by a diverter 60*a* inserted into the document travel path downstream of the roller cluster 24. The diverter 60*a* directs the document from the lower two rollers of the cluster into the upper two rollers where it is directed back across the platen 22 by a guide (not shown). The document is then urged across the platen in the direction, opposite to the proper scanning direction for first side exposure, by the rotating scuff roller 28 which has had its rotational direction of movement reversed. If more than one copy of the duplex document is desired, diverters 60*a* and 60*b* may remain in the document travel path and roller clusters 24 and 30 and scuff roller 28 appropriately reversed to shuttle the document back and forth across the platen 22. Otherwise, the diverters 60*a* and 60*b* are removed from such path so that the document exits the feeder 20 for operator retrieval.

After the first transferable image is transferred to the moving web 54, a receiver member is fed from its hopper 44 into the travel path $P_1$. The unit L times the transport of the receiver member with the movement of the webs 14 and 54 so that such member moves at a peripheral speed matching the peripheral speed of the web and is in register with the transferable images respectively carried by the webs. A corona charger 62 electrically coupled to the D.C. or biased A.C. potential source and a grounded back-up plate 62*a* on opposite sides of the web 54 effect transfer of the first image to the receiver member by producing an electrostatic field of sufficient level to attract marking particles of the first image from web 54 to a first side of the receiver member (facing such web). Subsequently, transfer of the second image to the receiver member is effected by corona charger 42 which produces an electrostatic field of sufficient level to attract marking particles of the second image from the web 14 to the opposite side of receiver member (facing such web) to produce the duplex copy on such receiver member. After the transfer operation is carried out the receiver member is stripped from the web 14 under tha assist of charger 48, transported through fuser assembly 46 to simultaneously fix both of the images to the receiver member, and delivered to hopper 50*b* for operator retrieval.

Figure 2:
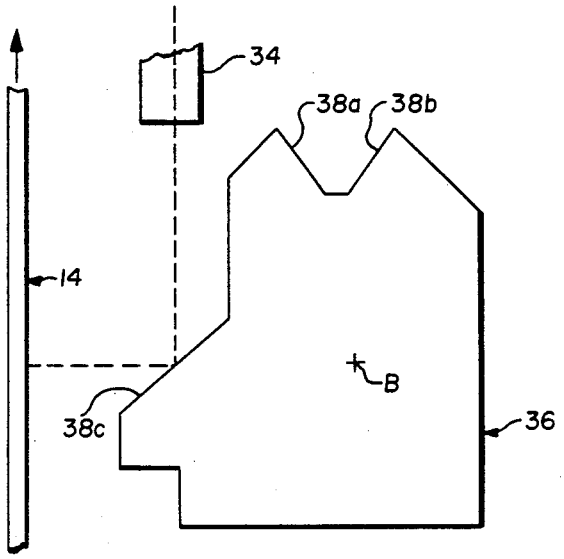
FIG. 2 is a front elevational view of a portion of an exposure mechanism including a mirror assembly for the reproduction apparatus of FIG. 1.

As is readily apparent, the first image undergoes two transfers (i.e., first to the web 54 and second to the receiver member, while the second image undergoes only one transfer (i.e., directly to the receiver member). In order for both sides of the reproduced copy to be right reading, the images must be wrong reading on the web from which transfer to the receiver member takes place. Accordingly, the first image must be formed as right reading on the web 14 to be wrong reading when transferred to the web 54, and the second image must be formed as wrong reading on the web 14. To accomplish this inversion of the second image relative to the first image, the mirror assembly 36 is selectively movable about its longitudinal axis B as described above. In the position of FIG. 2, the mirror assembly optically reverses the reflected light image of the scanned document twice so that the corresponding image formed on the web 14 is wrong reading; and in the position of FIG. 3, the mirror assembly optically reverses the reflected light image of the scanned document once so that the corresponding image formed on the web 14 is right reading. Of course, if the images are electronically formed, the images may automatically be correctly placed on the web as right reading and wrong reading.

Figure 5:
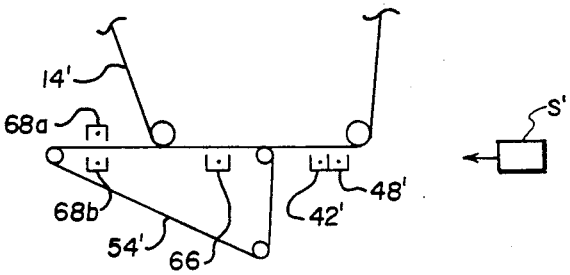
FIG. 5 is a schematic front elevational view of a modified dielectric web arrangement for the reproduction apparatus of FIG. 1.

In the embodiment of FIG. 1, three transfers take place under the influence of three chargers respectively; (1) transfer of first image from web 14 to web 54 by charger 58; (2) transfer of first image from web 54 to receiver member by charger 62; and (3) transfer of second image from web 14 to receiver member by charger 42. FIG. 5 shows an alternate arrangement of the webs and transfer chargers where only two chargers are required with all other aspects of the apparatus 10 being the same. In this embodiment, chargers 58 and 62 are replaced by a field reversing corona charger 66. The charger 66 is electrically coupled to a variable D.C. or biased A.C. potential source S'. At the proper time under the control of unit L, source S' produces an electrostatic field in one direction to effect transfer of the first image from the web 14' to the web 54', and an electrostatic field of equal level but opposite direction to effect transfer of the first image from the web 54' to the receiver member moving along its travel path. By making the electrostatic fields of equal level but opposite effective direction, control of the charger 66 is simplified. Additional chargers **68*a* and 68*b*, electrically coupled to an A.C. potential source, may be provided in this embodiment to effect tacking of a receiver member to the web 54'** if so desired.

Figure 6:
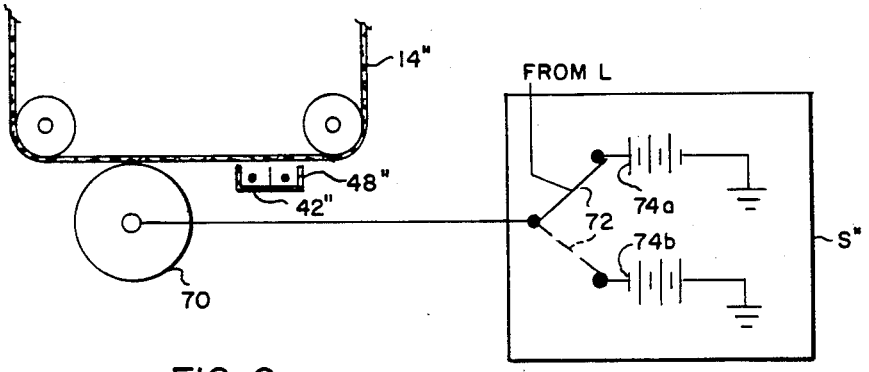
FIG. 6 is a schematic front elevational view of a modified arrangement for the reproduction apparatus of FIG. 1 utilizing a biased doner/tranfer roller in place of the second web.

In the alternate embodiment of FIG. 6, the web 54 of FIG. 1 is replaced by a donor/transfer roller 70 in nip relation with the web. The roller 70 is of a standard doner/transfer roller construction such as shown in aforementioned U.S. Pat. No. 3,847,478 for example, and is rotatably driven to move in synchronism with the web 14'' by direct coupling to the web drive or by a stepper motor controlled by unit L for example. A bias is applied to the roller 70 by a potential source S'' coupled to the roller through a switch 72 controlled by the unit L. The potential source S'' includes a positive D.C. (or positively biased A.C.) source **74*a* and a negative D.C. (or negatively biased A.C.) source 74*b*. Accordingly, when the switch 72 is positioned to couple source 74*a* to the roller 70, the bias will cause an electrostatic field of one effective direction to be generated at the nip; and when the switch 72 is positioned to couple source 74*b* to the roller 70, the bias will cause an electrostatic field of the opposite effective direction to be generated at the nip. Thus under one field effective direction a transferable image is transferred from the web 14'' to the roller 70, and under the opposite field effective direction such image is transferred to one side of a receiver member moving along its travel path. As such, roller 70 acts, in the same manner as described above with reference to web 54, to enable production of duplex copy in a single pass of the receiver member between roller 70 and web 14''**.

Figure 7:
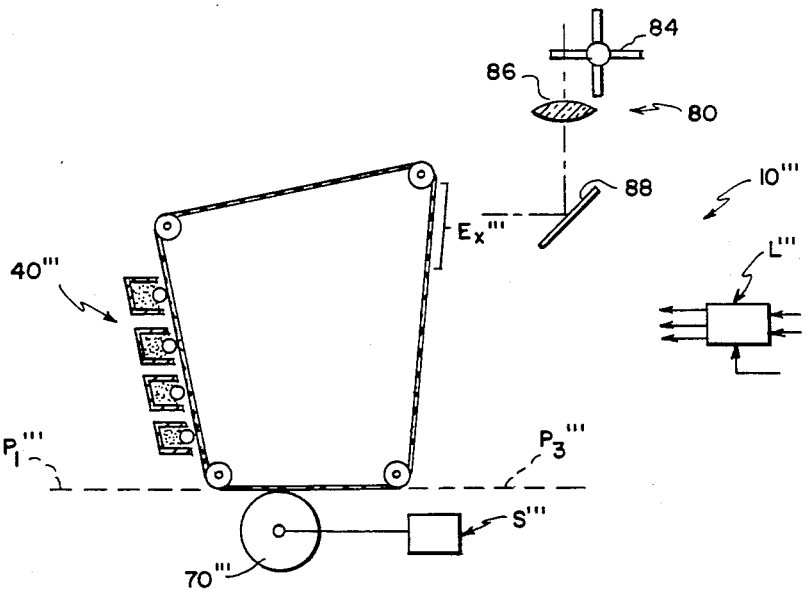
FIG. 7 is a schematic front elevational view, partly in cross-section, of an alternate embodiment of the reproduction apparatus of FIG. 1 capable of producing multicolor copies.

The alternate embodiment shown in FIG. 7 is an arrangement whereby the reproduction apparatus according to this invention can be utilized to produce multicolor copies. The apparatus 10''' includes a full frame optical system 80 (as opposed to the scanning optical system of FIG. 1 although scn exposure, electronic or electrostatic image formation may also be employed). The optical system 80 includes flash lamps for illuminating the full document on the platen (not shown). A reflected light image of the document is projected along an optical path onto the web 14''' through a filter wheel 84, a lens 86 and a mirror 88 to form, on the web, a charge pattern corresponding to a full frame latent color separation image. The unit L''' controls the optical system 80 such that a document is illuminated three times (four times if skeletal black is desired) through different segments of the filter wheel to expose the web 14''' and produce respective color separation image charge patterns on successive areas of the web 14'''. The developer station 40''' includes a plurality of magnetic brushes with respectively different colored marking particles. For example, with a simulated subtraction color printing process, exposure of the web 14''' is made through red, green and blue filter segments (plus a neutral density segment if skeletal black is desired) and the marking particles used for development of successive charge patterns to form transferable images are respectively cyan, magenta and yellow (plus black if desired). Of course, this arrangement may also be used to produce multiple image overlays, at least one of which is to be reproduced in a different color from the others (commonly referred to as spot color).

The donor/transfer roller 70''' (or a web similar to web 54 of FIG. 1) has a peripheral surface of a length measured in the direction of rotation equal to the dimension of an image frame of the web 14''' measured in the direction of travel plus the interframe between successive image frames. Accordingly, when the potential source S''' (e.g. similar to that shown in FIG. 6) is coupled to the roller 70''' so that the effective direction of the electrostatic field produced by the roller 70''' is set to transfer the transferable images to the roller, the successive transferable images are transferred to the roller in accurate superposition. Once all of the images are transferred to the roller 70''', the potential source S''' is reversed so that the effective direction of the electrostatic field produced by the roller 70''' is set to transfer the images in unison to a receiver member transported through the transfer nip between the roller 70''' and the web 14'''. This arrangement has a distinct advantage in that, since all of the images are transferred to the receiver member at one time, there is no potential for image misregistration as might occur with sequential transfers to the receiver member. Moreover, the receiver member transport path is simplified since it is not required that such sheet be recirculated for sequential transfers.

The invention has been described in detail with particular reference to preferred embodiments thereof, but it will be understood that variations and modifications can be effected within the spirit and scope of the invention.

We claim:

1. Electrographic reproduction apparatus capable of producing simplex or duplex copies on a receiver member traveling along a path, said apparatus including:

a first dielectric member movable along a first path, a portion of such first path being tangent to one side of such receiver member travel path;

means for sequentially forming transferable images, corresponding to information to be reproduced, on said first dielectric member;

a second member movable along a second path, one portion of said second path being tangent to such receiver member travel path on the opposite side from said first path, and another portion of said second path being located to position a portion of said second member in image transfer relation to said first dielectric member; and transfer means, located adjacent to the portion of the second path where said first and second members are in image transfer relation, for selectively establishing an electrostatic transfer field of a first effective direction for transferring one transferable image from said first dielectric member to said second member or of a second effective direction for transferring said one transferable image from said second member to one side of a receiver member.

2. The invention of claim 1 wherein said transfer means includes a source of electrical potential in operative relation with said second member, and means for controlling application of potential to said second member to selectively establish a field having a first effective direction or an opposite effective direction.

3. The invention of claim 2 wherein said source of electrical potential includes means for producing a positive potential, means for producing a negative potential of substantially equal absolute magnitude, and means for selectively switching between said positive potential producing means and said negtive potential producing means.

4. The invention of claim 3 wherein said first dielectric member is a first web traveling along a closed loop path, and said second member is a second web traveling along a closed loop path; and wherein said transfer means includes a corona charger located within the closed loop path of said second web adjacent to the portion of said path where the first and second webs are in image transfer relation, said charger being electrically coupled to said source of potential.

5. The invention of claim 4 wherein in said first and second webs have perforations adjacent to respective marginal edges thereof; and such reproduction apparatus further including a roller having sprocket teeth, said roller being supported within one of the closed loop paths of said first and second webs with said sprocket teeth engaging the perforations of said first and second webs, and means for rotating said roller whereby said sprocket teeth advance said first and second webs along their respective closed loop paths in synchronism.

6. The invention of claim 3 wherein said second member is a roller mounted for rotation about its longitudinal axis, said roller having a conductive core, and wherein said source of electrical potential for said transfer roller is electrically coupled to said core.

7. The invention of claim 3 wherein said reproduction apparatus further includes control means, operatively coupled to said transfer means, for effecting in order (i) transfer of sequential transferable images in superimposed register from said first dielectric member to said second member, and (ii) transfer of such superimposed images in unison from said second member to a receiver member traveling in a continuous direction along its travel path.

8. The invention of claim 1 wherein said transfer means further includes means, located adjacent to the portion of the first path which is tangent to said receiver member travel path, for transferring a second image from said first dielectric member to the opposite side of such receiver member; and control means, operatively coupled to said transfer means, for effecting in order (i) transfer of one transferable image from said first dielectric member to said second member, (ii) transfer of said one image from said second member to one side of a receiver member traveling in a continuous direction along its travel path, and (iii) transfer of a second image from said first dielectric member to the opposite side of such receiver member to produce a duplex copy.

9. The invention of claim 1 wherein said means for sequentially forming transferable images on said first dielectric member includes means for forming a series of images in respectively different colors, and wherein said transfer means transfers each of said series of images in superimposed register from said first dielectric member to said second member and then in unison from said second member to one side of a receiver member.

10. Electrographic reproduction apparatus capable of producing simplex or duplex copies on a receiver member traveling along a path, said apparatus including:

a first photoconductive web movable along a first path, a portion of such first path being tangent to and on one side of such receiver member travel path;

means for illuminating information to be reproduced to produce a light image thereof;

a mirror assembly having a plurality of mirror surfaces, said assembly being selectively movable to a first position wherein a pair of said mirror surfaces are located in an optical path between said information to be reproduced and said first web so that a light image of information to be reproduced is projected to said first web for forming a right reading latent image thereof, or a second position where a single one of said mirror surfaces is located in an optical path between said information to be reproduced and said first web so that a light image of information to be reproduced is projected to said first web for forming a wrong reading latent image thereof;

means for developing such latent images with marking particles to respectively form a right reading transferable image and a wrong reading transferable image on said first web;

a second web movable along a second path, one portion of said second path being tangent to such receiver member travel path on the opposite side from said first path, and another portion of said second path being located to position a portion of said second web in image transfer relation to said first web; and means for selectively effecting transfer of (i) said right reading transferable image from said first web to said second web so as to be wrong reading thereon, (ii) such wrong reading image from said second web to one side of a receiver member traveling along its travel path so as to be right reading thereon, and (iii) said wrong reading transferable image from said first web to the opposite side of such receiver member so as to be right reading thereon.

11. The invention of claim 10 wherein said selective transfer effective means includes a source of electrical potential in operative relation with said second web, and means for controlling application of potential from said source to said second web to selectively establish a field having a first effective direction for transferring one transferable image from said first web to said second web, or an opposite effective direction for transferring such one image from said second web to one side of a receiver member.

12. The invention of claim 10 wherein said electrical potential source includes means for producing a positive potential, means for producing a negative potential of substantially equal absolute magnitude, and means for selectively switching between said positive potential producing means and said negative potential producing means.

* * * * *